US009285762B2

(12) United States Patent
Hasegawa

(10) Patent No.: US 9,285,762 B2
(45) Date of Patent: Mar. 15, 2016

(54) END MEMBER, ROTARY BODY UNIT AND PHOTORECEPTOR DRUM UNIT

(71) Applicant: MITSUBISHI CHEMICAL CORPORATION, Chiyoda-ku (JP)

(72) Inventor: Takao Hasegawa, Odawara (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 14/631,069

(22) Filed: Feb. 25, 2015

(65) Prior Publication Data

US 2016/0033931 A1 Feb. 4, 2016

(30) Foreign Application Priority Data

Jul. 31, 2014 (JP) ..... 2014-004096

(51) Int. Cl.
*G03G 15/00* (2006.01)
*G03G 21/16* (2006.01)

(52) U.S. Cl.
CPC ..... *G03G 21/1671* (2013.01)

(58) Field of Classification Search
CPC ..... G03G 21/1671; G03G 15/757
USPC ..... 399/117, 167; 492/47
See application file for complete search history.

(56) References Cited

U.S. PATENT DOCUMENTS

| | | | | |
|---|---|---|---|---|
| 7,020,410 | B2 * | 3/2006 | Zogg | G03G 15/751 399/117 |
| 8,718,516 | B2 * | 5/2014 | Huck | G03G 15/757 399/167 |
| 8,768,218 | B2 * | 7/2014 | Huck | G03G 15/757 399/167 |
| 2005/0117934 | A1 | 6/2005 | Murayama et al. | |
| 2009/0080936 | A1 * | 3/2009 | Parisi | G03G 15/757 399/117 |
| 2010/0196047 | A1 * | 8/2010 | Jin | G03G 21/186 399/111 |
| 2014/0072342 | A1 * | 3/2014 | Iijima | G03G 15/757 399/167 |

FOREIGN PATENT DOCUMENTS

JP 3782807 B2 6/2006

* cited by examiner

*Primary Examiner* — Susan Lee
(74) *Attorney, Agent, or Firm* — Oblon, McClelland, Maier & Neustadt, L.L.P.

(57) ABSTRACT

An end member is mounted on an end of a cylindrical rotary body. The end member includes a cylindrical-shaped body and a shaft connecting portion protruding from one end side of the body. The shaft connecting portion includes a penetration hole extending toward an axial line of the body, and no shaft connecting portion exists at a portion of the body disposed opposed to the penetration hole across the axial line of the body.

8 Claims, 10 Drawing Sheets

END MEMBER, ROTARY BODY UNIT AND PHOTORECEPTOR DRUM UNIT

CROSS REFERENCE TO RELATED APPLICATIONS

This application is based upon and claims the benefit of priority of Japanese Utility Model Application No. 2014-004096 filed on Jul. 31, 2014, the contents of which are incorporated herein by reference in its entirety.

BACKGROUND OF THE INVENTION

1. Field of the Invention

The present invention relates to an end member to be mounted on the end portion of a cylindrical rotary body incorporated in a process cartridge removably mounted on an image forming apparatus such as a laser printer and a copying machine. The present invention also relates to a rotary body unit including such end member.

2. Description of the Related Art

An image forming apparatus such as a laser printer and a copying machine includes a process cartridge to be removably mounted on the body of the image forming apparatus (which is also hereinafter called "apparatus body").

A process cartridge is used to form contents to be expressed such as characters and figures and transfer them to a recording medium such as paper. More specifically, the process cartridge includes a photoreceptor drum serving as a cylindrical rotary body for forming therein images to be transferred. The process cartridge includes, besides the photoreceptor drum, other various devices used to form images in the photoreceptor drum. The devices include, for example, a developing roller unit, a charging roller unit and a cleaning device.

In the case of a process cartridge, for maintenance of a currently used process cartridge, another process cartridge of the same type may be mounted onto and removed from the apparatus body; otherwise the currently used process cartridge may be removed from the apparatus body and a new one may be then mounted onto the apparatus body.

Here, the cylindrical rotary body (for example, photoreceptor drum, developing roller, charging roller) to be incorporated in the process cartridge is structured to rotate about its axis on receiving a rotation drive force from the apparatus body. Thus, the process cartridge includes, for example, as disclosed in Japanese Patent No. 3782807, a housing forming its contour, while the cylindrical rotary body is rotatably held within the housing. Accordingly, the cylindrical rotary body includes end members respectively in its two ends, while there is mounted a shaft penetrating through the end members and cylindrical rotary body in the axial direction. And, the two ends of this shaft are arranged across the interior of the housing of the process cartridge.

SUMMARY OF THE INVENTION

In view of the technology of the related art, in a unit (a photoreceptor drum unit or a developing roller unit) including a cylindrical rotary body and an end member, the present invention provides an end member which can make the unit more compact than the unit of the related art and can facilitate the assembling of the unit to the shaft. Also, the present invention provides a rotary body unit including such end member.

Description is given below of the present invention. Here, for easy understanding, reference numerals and signs are given using brackets, but the present invention is not limited to this.

A first aspect of the present invention provides an end member (20) to be mounted on an end of a cylindrical rotary body, the end member including: a cylindrical-shaped body (21); and a shaft connecting portion (23) protruding from one end side of the body, wherein the shaft connecting portion includes a penetration hole (23*a*) extending toward an axial line of the body, and no shaft connecting portion exists at a portion of the body disposed opposed to the penetration hole across the axial line of the body.

Here, the cylindrical rotary body is a conceptual structural body including a solid rotary body in a round bar shape which rotates around its axial line and a hollow rotary body in a cylinder hollow shape which rotates around its axial line.

A second aspect of the present invention provides an end member (20) according to the first aspect, wherein the shaft connecting portion (23) is formed in a range of smaller than 180° around the axial line of the body.

A third aspect of the present invention provides an end member (20) according to the first or second aspect, wherein the body has a hole (21*a*) penetrating therethrough in a direction of the axial line.

A fourth aspect of the present invention provides an end member (20) according to any one of the first to third aspects, wherein the penetration hole (23*a*) of the shaft connecting portion (23) is tapered.

A fifth aspect of the present invention provides a rotary body unit (10), including a cylindrical rotary body (11) and the end member (20) according to any one of the first to fourth aspects to be mounted on an end of the cylindrical rotary body.

A sixth aspect of the present invention provides an end member (20) to be mounted on an end of a cylindrical rotary body (11), the end member including: a cylindrical-shaped body (21) having a hole (21*a*) penetrating therethrough in a direction of an axial line of the body; a ring-shaped contact wall (22) rising along an outer peripheral surface of the body on one end side in the direction of the axial line to spread an outside diameter of the body; grooves (21*b*) or uneven sections formed on a lateral side of the body; one or more shaft connecting portions (23; 123; 223; 323) protruding from the one end side of the body around the axial line of the body; and a ground pin (24) which protrudes from the other end side of the body, wherein each of the one or more shaft connecting portions includes a penetration hole (23*a*) extending toward the axial line of the body, and the one or more shaft connecting portions do not exist at a portion of the body disposed opposed to the penetration hole across the axial line of the body.

A seventh aspect of the present invention provides a rotary body unit (10), including a cylindrical rotary body (11) and the end member (20) according to the sixth aspect to be mounted on an end of the cylindrical rotary body.

An eighth aspect of the present invention provides a photoreceptor drum unit (10), including a photoreceptor drum (11) and the end member (20) according to the sixth aspect to be mounted on an end of the photoreceptor drum.

According to the end member and rotary body unit of the present invention, since the structure of the end member can be simplified and miniaturized, the unit can be also miniaturized. Since the portion of the end member used to pass a pin for assembling the pin with shaft is reduced, assembling the pin with shaft can be facilitated.

DETAILED DESCRIPTION OF THE EXEMPLARY EMBODIMENTS

Figure 1:
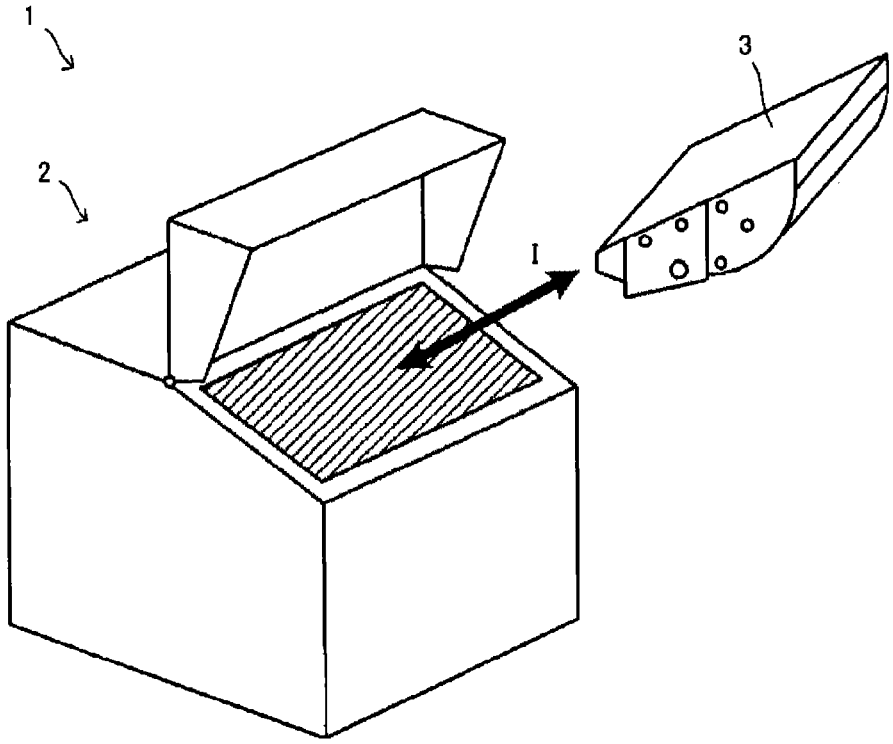
FIG. 1 is a conceptual diagram of an image forming apparatus body 2 and a process cartridge 3.

The present invention is described below with reference to embodiments shown in the drawings. However, the present invention is not limited to those embodiments.

FIG. 1 is an explanatory view of an embodiment, that is, it is a typical perspective view of an image forming apparatus 1 including a process cartridge 3 and an image forming apparatus body 2 (which is hereinafter described also as "apparatus body 2") to be used with the process cartridge 3 mounted therein. The process cartridge 3 can be mounted into and removed from the apparatus body 2 by moving it in a direction shown by a thick arrow line I in FIG. 1.

Figure 2:
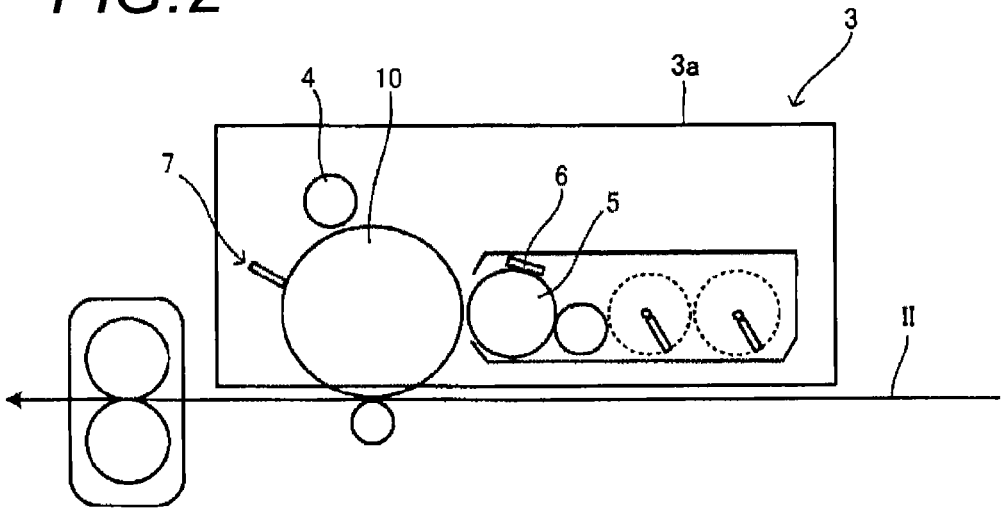
FIG. 2 is an explanatory conceptual diagram of the structure of the process cartridge 3.

FIG. 2 shows typically the structure of the process cartridge 3. As can be seen from FIG. 2, the process cartridge 3 contains within a housing 3*a* a photoreceptor drum unit 10 (see FIG. 3), a charging roller unit 4, a developing roller unit 5, a restrict member 6 and a cleaning blade 7. With the process cartridge 3 mounted in the apparatus body 2, when a recording medium such as paper is moved along a line shown by II in FIG. 2, an image is transferred from the photoreceptor drum unit 10 to the recoding medium.

The process cartridge 3, as can be seen from FIG. 2, includes the charging roller unit 4, developing roller unit 5, restrict member 6, cleaning blade 7 and photoreceptor drum unit 10, while they are contained within the housing 3*a*. Description is given below of them.

The charging roller unit 4, which is an example of the rotary body unit, charges the photoreceptor drum 11 of the photoreceptor drum unit 10 on receiving a voltage from the apparatus body 2. Such charging is carried out in such a manner that the charging roller of the charging roller unit 4 is rotated following the photoreceptor drum unit 10 and is contacted with the outer peripheral surface of the photoreceptor drum 11.

The developing roller unit 5 is an example of the rotary body unit and is used to supply developer to the photoreceptor drum 11. The developing roller unit 5 develops an electrostatic latent image formed on the photoreceptor drum 11. Here, a fixed magnet is built in the developing roller unit 5.

The restrict member 6 is used to adjust the quantity of the developer attached to the outer peripheral surface of the developing roller unit 5 and also to apply frictionally charged charges to the developer itself.

The cleaning blade 7 can be contacted with the outer peripheral surface of the photoreceptor drum 11 to remove the remaining developer after transfer using its tip end.

Figure 3:
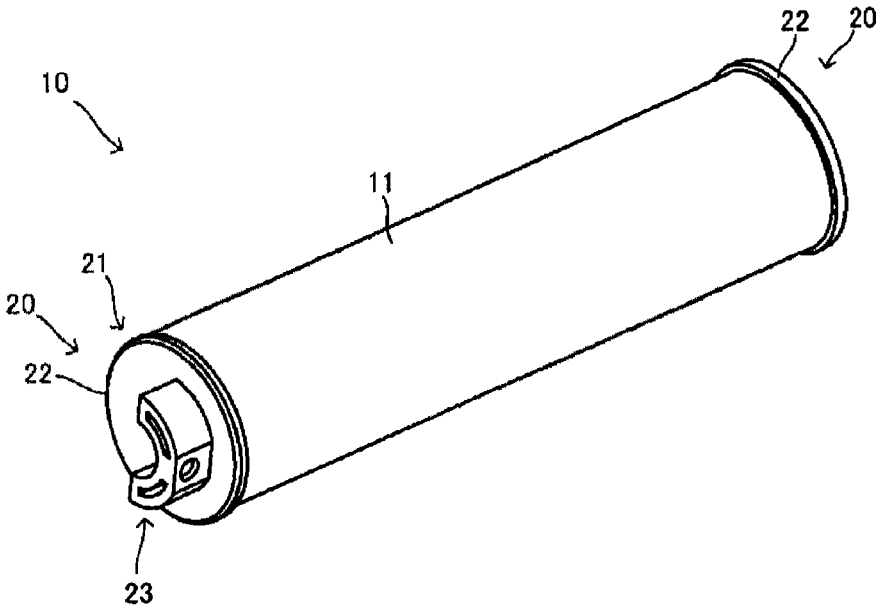
FIG. 3 is a diagrammatic perspective view of a photoreceptor drum unit 10.
Figure 4A:
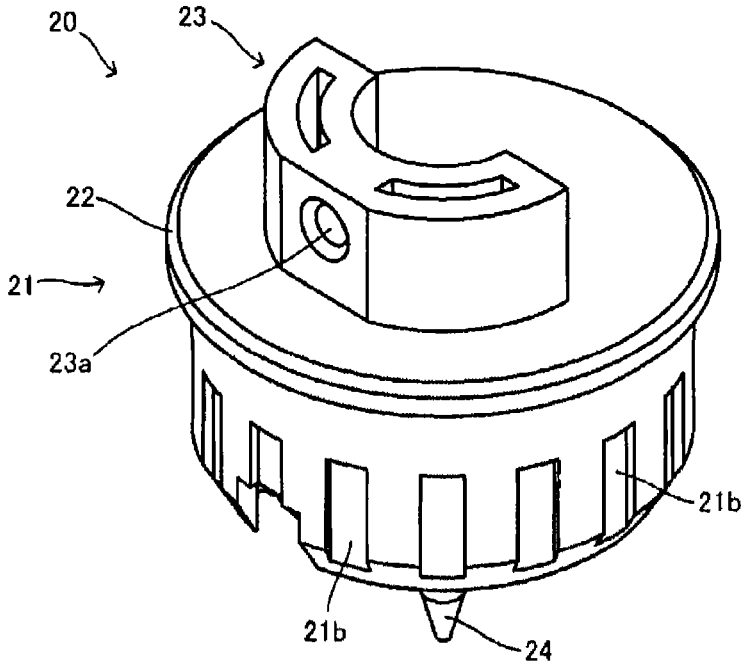
FIG. 4A is a diagrammatic perspective view of an end member 20.
Figure 4B:
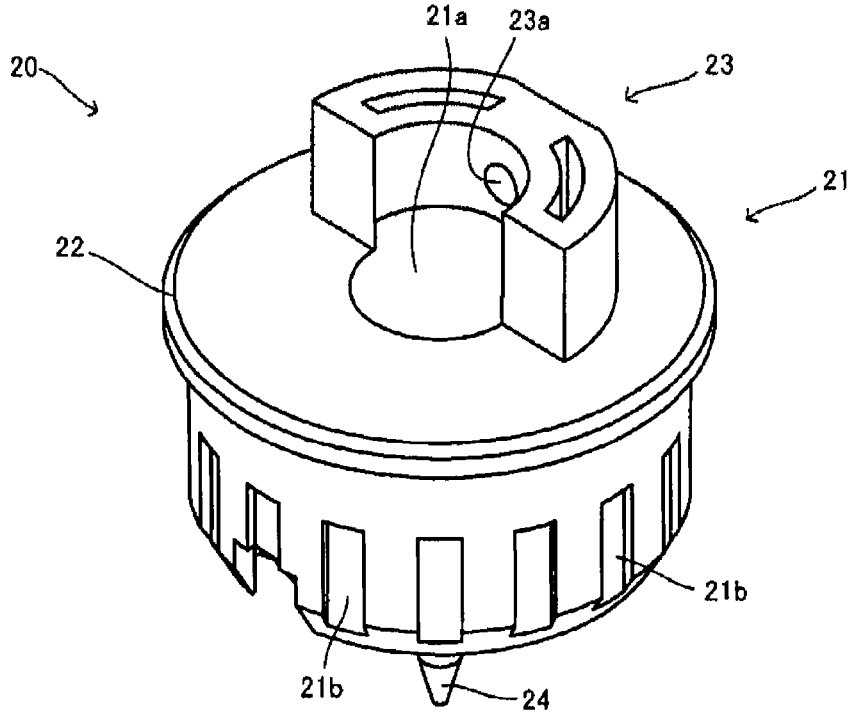
FIG. 4B is a diagrammatic perspective view of the end member 20 viewed from a viewpoint other than FIG. 4A.
Figure 5A:
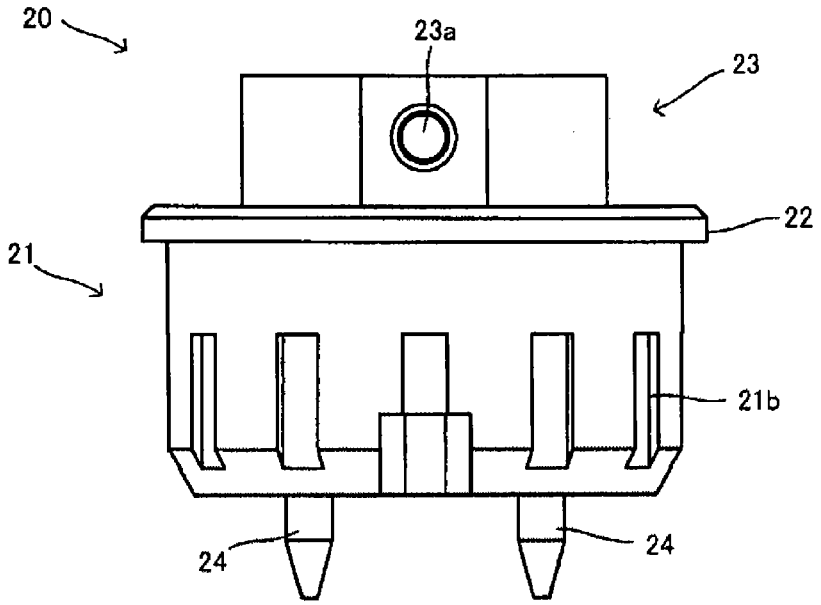
FIG. 5A is a front view of the end member 20.
Figure 5B:
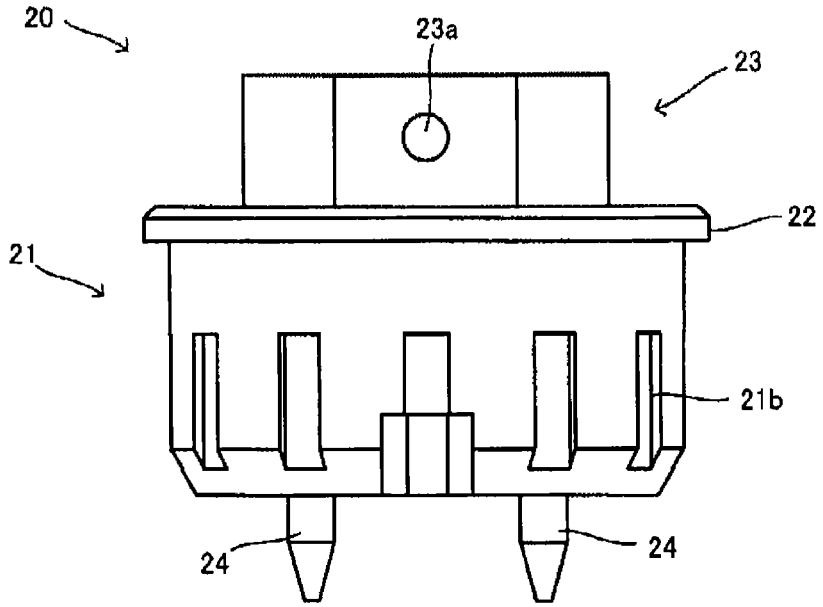
FIG. 5B is a back view of the end member 20.
Figure 6A:
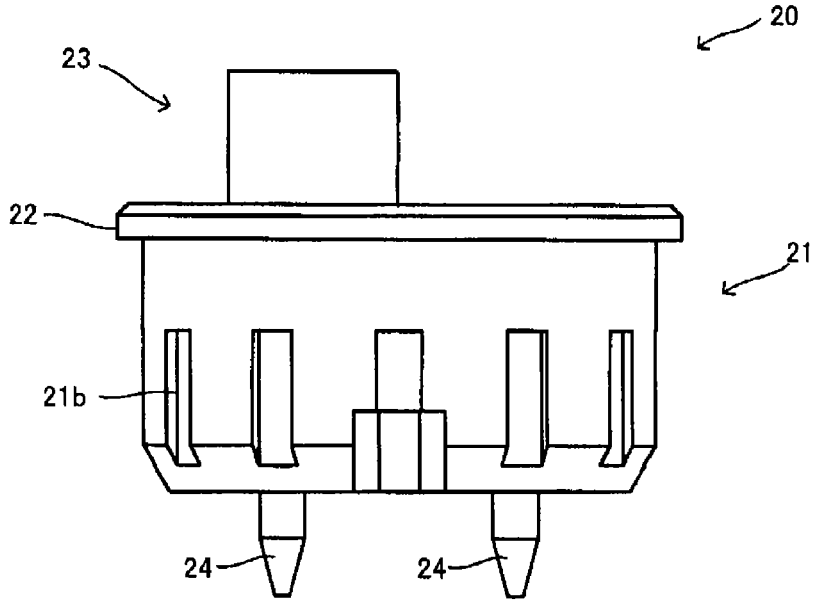
FIG. 6A is a right side view of the end member 20.
Figure 6B:
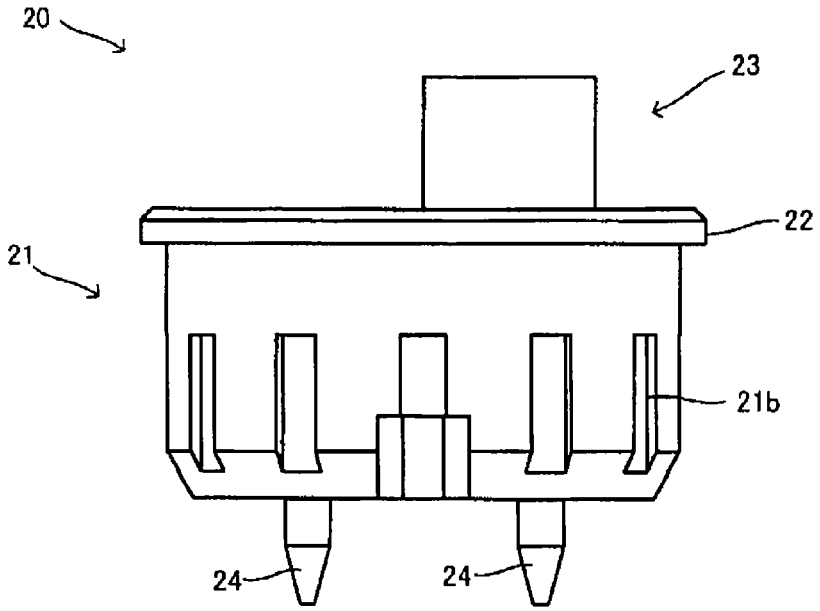
FIG. 6B is a left side view of the end member 20.
Figure 7A:
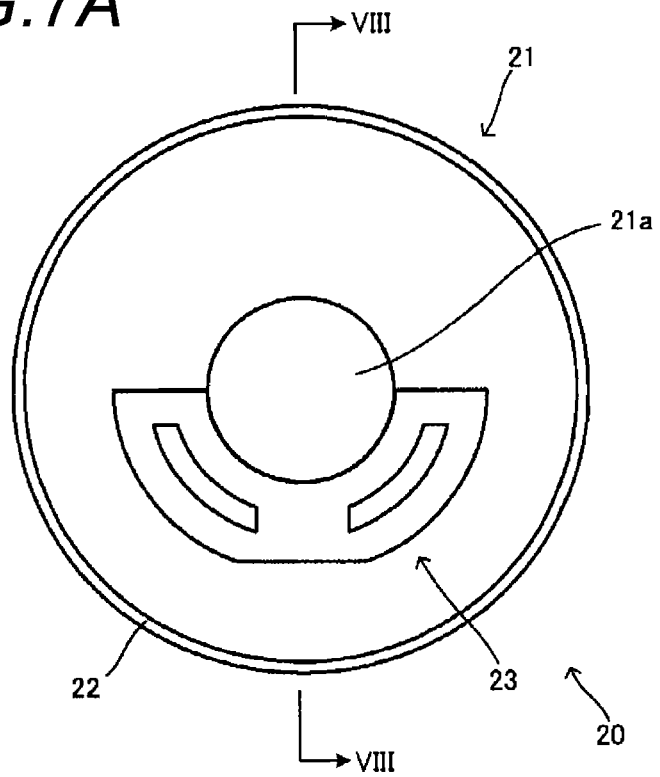
FIG. 7A is a plan view of the end member 20.
Figure 7B:
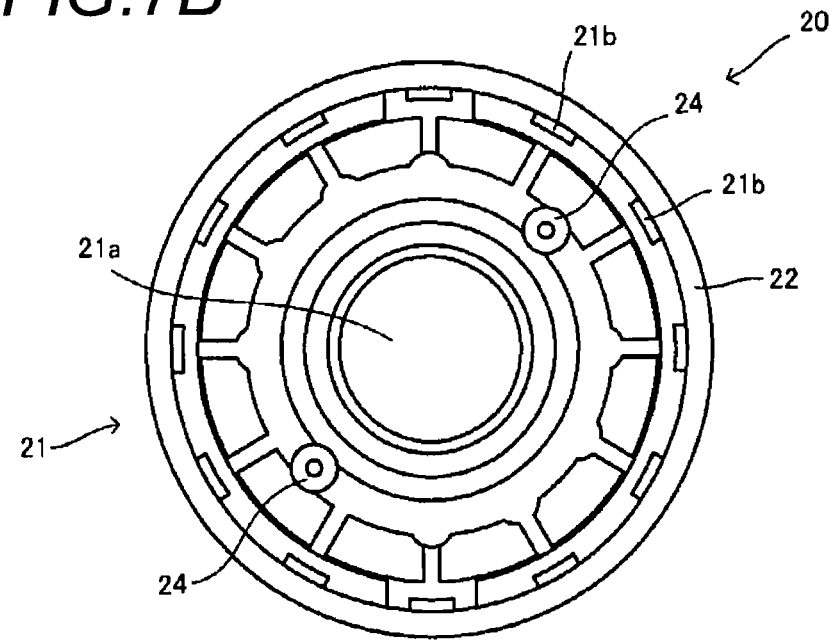
FIG. 7B is a bottom view of the end member 20.
Figure 8:
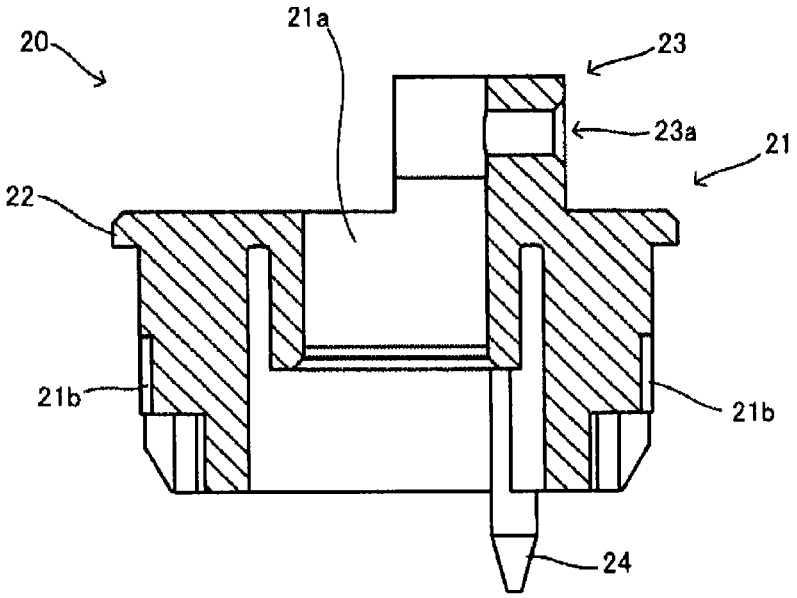
FIG. 8 is a sectional view of the end member 20.

The photoreceptor drum unit 10 is an example of the rotary body unit, on the surface of which there can be formed images such as characters and figures to be transferred to the recording medium such as paper. FIG. 3 is a diagrammatic perspective view of the photoreceptor drum unit 10. As can be seen from FIG. 3, the photoreceptor drum unit 10 includes a photoreceptor drum 11 and end members 20. FIG. 4A is a perspective view of the end member 20, and FIG. 4B is a perspective view thereof viewed from other viewpoint. Also, FIG. 5A is a front view of the end member 20, FIG. 5B is a back view thereof, FIG. 6A is a right side view thereof, FIG. 6B is a left side view thereof, FIG. 7A is a plan view thereof, and FIG. 7B is a bottom view thereof. FIG. 8 is a sectional view taken along the VIII-VIII line shown in FIG. 7A.

The photoreceptor drum 11, which is an example of a cylindrical rotary body, includes a cylindrical drum cylinder and a photosensitive layer applied to the outer peripheral surface of the drum cylinder. That is, the drum cylinder is a conductive cylinder made of aluminum or the like and the photosensitive layer is applied to the outer periphery thereof. In this embodiment, on the two ends of the photoreceptor drum 11, there are respectively arranged end members 20 to be described next.

The end members 20 are respectively mounted on the two ends of the photoreceptor drum 11 and each includes a cylindrical-shaped body 21 having a hole 21*a* penetrating therethrough along its axial line. On one axial-line direction end side of the body 21, there is provided a ring-shaped contact wall 22 rising along its outer peripheral surface to spread the outside diameter of the body 21. The outside diameter of the body 21 is substantially the same as the inside diameter of the photoreceptor drum 11 and, when the other end side of the body 21 disposed opposed to the contact wall 22 arranged side is inserted into and engaged with the photoreceptor drum 11, the end member 20 can be fixed to the photoreceptor drum 11. In this case, the body 21 is inserted down to the depth where the end face of the photoreceptor drum 11 is contacted with the contact wall 22. For stronger fixture, there may also be used an adhesive agent. Moreover, grooves 21*b* or uneven sections may also be formed in the portion of the body 21 where the adhesive agent is applied. Thus, the adhesive agent is held in the grooves 21*b* or uneven sections, thereby further strengthening the adhesion of the photoreceptor drum 11 and body 21.

The end member 20 further includes, on its contact wall 22 arranged side end face, a shaft connecting portion 23 formed to protrude therefrom. The shaft connecting portion 23 has a penetration hole 23*a* which, in a plan view, extends toward the axial line of the body 21 along a line serving as one of the diameters of the body 21.

The shaft connecting portion 23 is arranged in a part of the outside of the hole 21*a* of the body 21 in a plan view, while any part of the shaft connecting portion 23 does not exist in the portion of the body 21 that is opposed to the penetration hole 23*a*. That is, the shaft connecting portion 23 is cut out in such opposed portion. This, as will be described later, can simplify the structure of the end member and thus can miniaturize it. Also, since the number of portions for passing the pin 31 (see FIGS. 11A and 11B) for connection with the shaft 30 (see FIG. 10) is small (the number is one), its assembly with the shaft 30 can be facilitated.

In this embodiment, the number of shaft connecting portions 23 is one, and in a plan view, the shaft connecting portion 23 is formed in the range of 180° around the axial line of the body 21.

Also, in this embodiment, the body 21 includes a ground pin 24 which protrudes from the end thereof disposed opposed to the shaft connecting portion 23 arranged side.

Figure 9A:
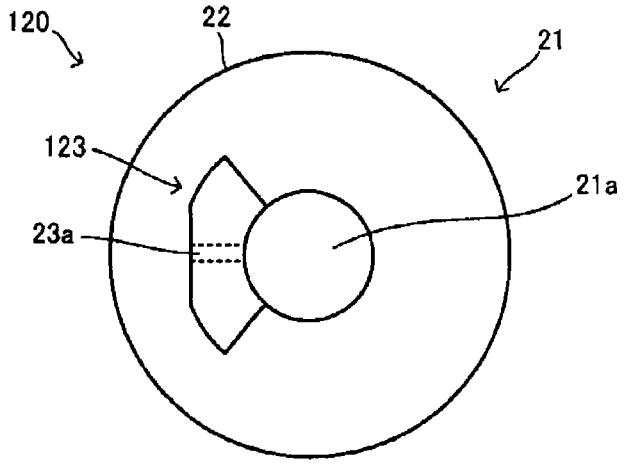
FIG. 9A is a plan view of an end member 120.
Figure 9B:
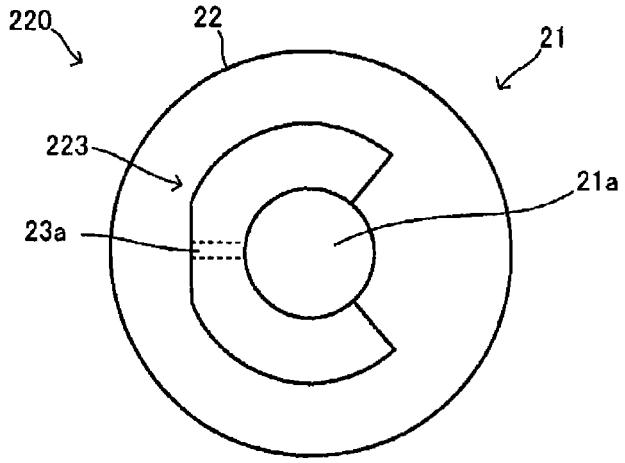
FIG. 9B is a plan view of an end member 220.
Figure 9C:
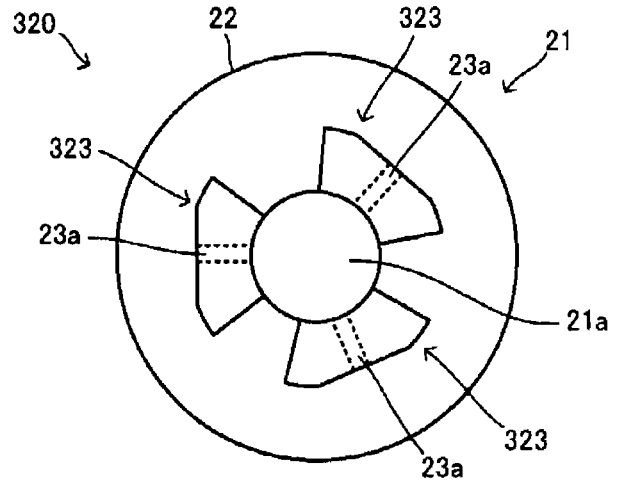
FIG. 9C is a plan view of an end member 320.

FIGS. 9A, 9B and 9C are respectively explanatory plan views of other embodiments.

An end member 120 shown in FIG. 9A includes one shaft connecting portion 123 which, in a plan view, extends in a range of smaller than 180° around the axial line of the body 21.

An end member 220 shown in FIG. 9B includes one shaft connecting portion 223 which, in a plan view, extends in a range of larger than 180° around the axial line of the body 21.

An end member 320 shown in FIG. 9C includes multiple shaft connecting portions 323.

These end members 120, 220 and 320 are also structured such that they are not arranged in the opposed portions of the penetration hole(s) 23*a*, thereby providing similar effects to the previously described embodiment. From the viewpoint that the quantity of the material forming the shaft connecting portion can be reduced, preferably, the number of shaft connecting portions may be one and it may be formed in a range which, in a plan view, extends in a range of 180° or smaller around the axial line of the body 21.

The penetration hole may also be inclined (so called tapered) such that, in a plan view, its section area is wide on the opposite side of the axial line side of the body 21 and its section narrows toward such axial line. This can further facilitate the insertion of the pin 31 (see FIGS. 11A and 11B).

Figure 10:
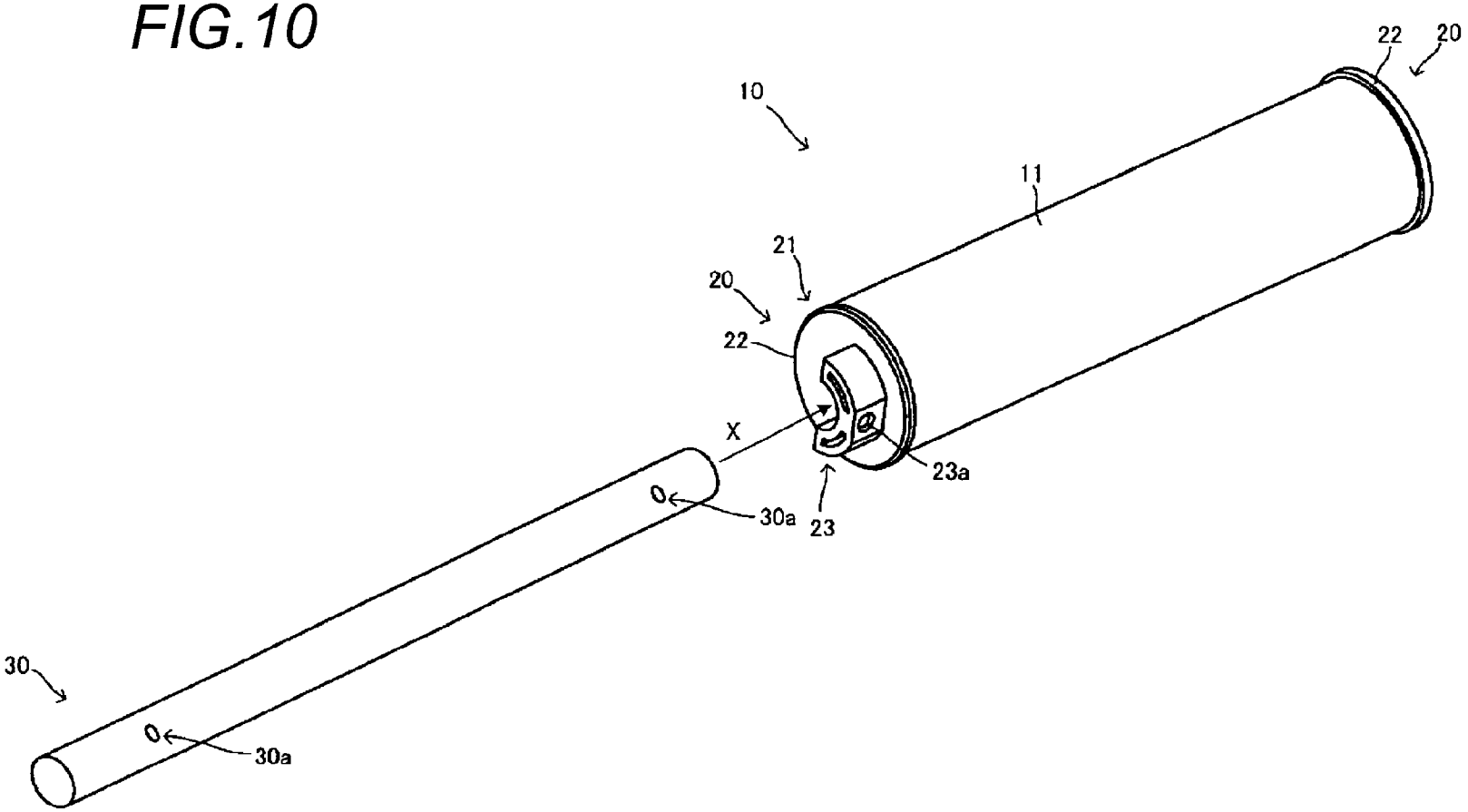
FIG. 10 is an exploded perspective view of the photoreceptor drum unit 10 and a shaft 30.
Figure 11A:
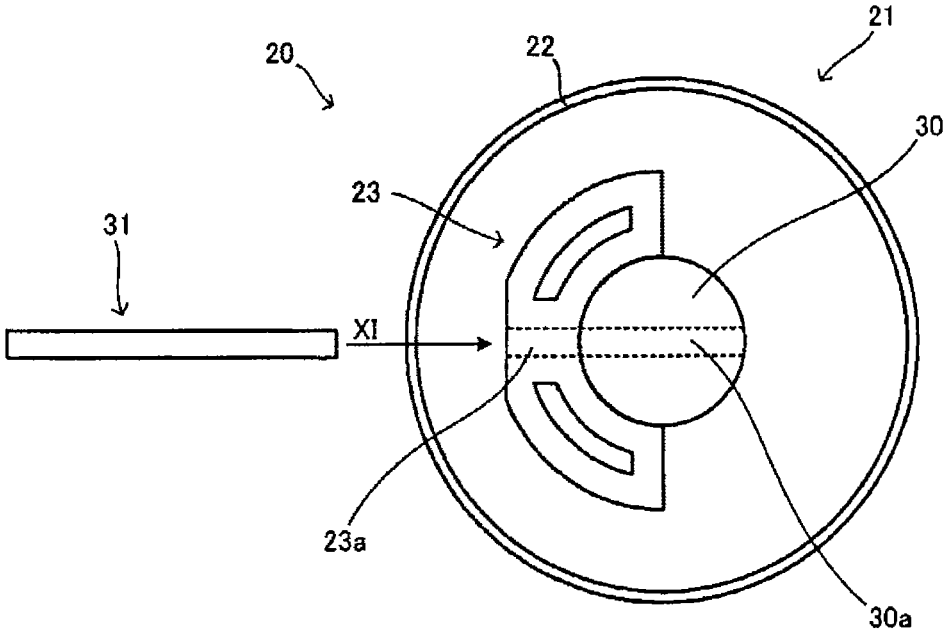
FIG. 11A is one view to explain how to mount a pin 31.
Figure 11B:
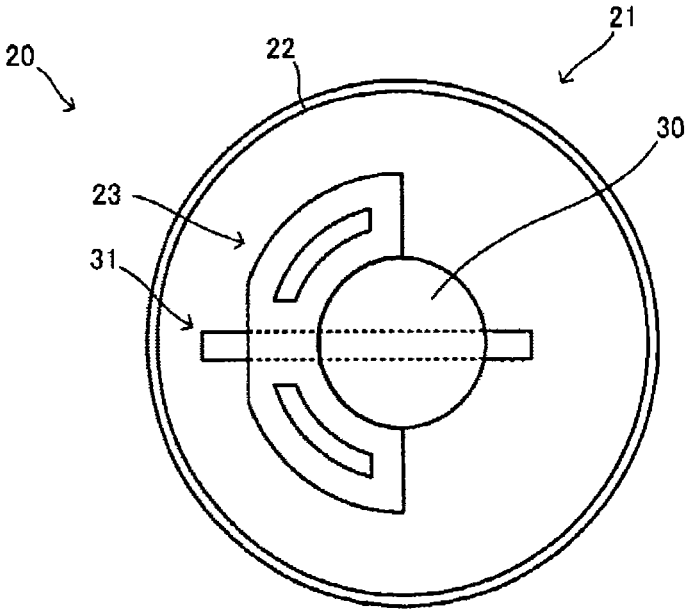
FIG. 11B is the other view to explain how to mount the pin 31.

The photoreceptor drum unit 10 including the above end member is mounted into the process cartridge 3, for example, in the following manner. FIGS. 10, 11A and 11B explain how to mount the unit 10.

FIG. 10 is a perspective view in which the shaft 30 and photoreceptor drum unit 10 are separated from each other, FIG. 11A is a view thereof when viewed from a direction assuming that the axial line of the photoreceptor drum unit 10 is the vertical direction of the view sheet, showing a state where the pin 31 is separated, and FIG. 11B is a view when viewed from the same direction as FIG. 11A, showing a state where the pin 31 is mounted.

As shown in FIG. 10, the process cartridge 3 includes a round bar-like shaft 30. The shaft 30 has a hole 30*a* orthogonal to the axial line of the shaft 30 and penetrating through the shaft 30. This hole 30*a* is formed at a position where, while the shaft 30 is mounted in the photoreceptor drum unit 10, the hole 30*a* communicates with the penetration hole 23*a* formed in the shaft connecting portion 23 of the end member 20.

As shown by an arrow X in FIG. 10, one end side of the shaft 30 is inserted from the hole 21*a* of one end member 20 through the photoreceptor drum 11 up to the hole 21*a* of the other end member 20. Thus, the shaft 30 is arranged in the process cartridge 3 while penetrating through the photoreceptor drum unit 10 in such a manner that its two ends protrude from the two ends of the photoreceptor drum unit 10 respectively. In this case, as shown in FIG. 11A, the shaft 30 is positioned such that its hole 30*a* communicates with the penetration hole 23*a* of the shaft connecting portion 23 of the end member 20.

Thus, while the shaft 30 is arranged in the photoreceptor drum unit 10, as can be seen from FIG. 11A, it is positioned such that the penetration hole 23*a* of the shaft connecting portion 23 of the end member 20 and the hole 30*a* of the shaft 30 are in communication with each other. In this state, as shown by an arrow XI in FIG. 11A, the round bar-like pin 31 is inserted from the shaft connecting portion 23 side. Accordingly, as shown in FIG. 11B, the pin 31 is positioned to extend through the shaft connecting portion 23 and shaft 30, whereby the end member 20 and shaft 30 are connected together through the pin 31.

The shaft 30 is rotatably held while its two ends held by the photoreceptor drum unit 10 are arranged across the interior of the housing 3*a*. This enables the photoreceptor drum unit 10 also to rotate together with the shaft 30.

According to the above structure of the end member, since the number of penetration holes 23*a* for insertion of the pin 31 is one, the mounting of the pin 31 can be facilitated and thus the efficiency of the above assembly can be enhanced. Also, since the shaft connecting portion can be formed smaller than the one of the related art, miniaturization and material reduction can also be realized.

Although description has been given heretofore of the photoreceptor drum unit 10 as an embodiment of the rotary body unit, this is not limitative but the above end member can also be applied similarly to a developing roller unit and a charging roller unit which are other forms of the rotary body unit. In this case, the developing roller of the developing roller unit and the charging roller of the charging roller unit function as the cylindrical rotary body.

What is claimed is:

1. An end member to be mounted on an end of a cylindrical rotary body, the end member comprising:

a cylindrical-shaped body; and a shaft connecting portion protruding from one end side of the body, wherein the shaft connecting portion includes a penetration hole extending toward an axial line of the body, and no shaft connecting portion exists at a portion of the body disposed opposed to the penetration hole across the axial line of the body.

2. The end member according to claim 1, wherein the shaft connecting portion is formed in a range of smaller than 180° around the axial line of the body.

3. The end member according to claim 1, wherein the body has a hole penetrating therethrough in a direction of the axial line.

4. The end member according to claim 1, wherein the penetration hole of the shaft connecting portion is tapered.

5. A rotary body unit, comprising a cylindrical rotary body and the end member according to claim 1 to be mounted on an end of the cylindrical rotary body.

6. An end member to be mounted on an end of a cylindrical rotary body, the end member comprising:

a cylindrical-shaped body having a hole penetrating therethrough in a direction of an axial line of the body;

a ring-shaped contact wall rising along an outer peripheral surface of the body on one end side in the direction of the axial line to spread an outside diameter of the body;

grooves or uneven sections formed on a lateral side of the body;

one or more shaft connecting portions protruding from the one end side of the body around the axial line of the body; and a ground pin which protrudes from the other end side of the body, wherein each of the one or more shaft connecting portions includes a penetration hole extending toward the axial line of the body, and the one or more shaft connecting portions do not exist at a portion of the body disposed opposed to the penetration hole across the axial line of the body.

7. A rotary body unit, comprising a cylindrical rotary body and the end member according to claim 6 to be mounted on an end of the cylindrical rotary body.

8. A photoreceptor drum unit, comprising a photoreceptor drum and the end member according to claim 6 to be mounted on an end of the photoreceptor drum.

* * * * *